US005569401A

United States Patent [19]

Gilliland et al.

[11] Patent Number: 5,569,401

[45] Date of Patent: Oct. 29, 1996

[54] INSULATED HEATING CONTAINER

[76] Inventors: Linda L. Gilliland, 301 Hickory Dr., Longwood, Fla. 32779; Mary R. Downs, 2206 Morriswood Ct., Franklin, Tenn. 37064

[21] Appl. No.: 354,728

[22] Filed: Dec. 6, 1994

Related U.S. Application Data

[63] Continuation of Ser. No. 30,018, Sep. 23, 1994, Pat. No. Des. 365,728.

[51] Int. Cl.[6] ..... F24C 7/10

[52] U.S. Cl. ..... 219/386; 219/521

[58] Field of Search ..... 219/385, 386, 219/387, 521, 528, 529; 34/202

[56] References Cited

U.S. PATENT DOCUMENTS

| | | | |
|---|---|---|---|
| 2,505,405 | 4/1950 | Jarboe | 219/19 |
| 2,577,870 | 12/1951 | Aston | 219/19 |
| 3,381,115 | 4/1968 | Welch | 219/441 |
| 3,805,018 | 4/1974 | Luong et al. | 219/387 |
| 4,537,313 | 8/1985 | Workman | 206/545 |
| 4,559,442 | 12/1985 | Graham | 219/385 |
| 4,630,671 | 12/1986 | Sherman et al. | 165/61 |
| 4,916,290 | 4/1990 | Hawkins | 219/385 |
| 4,927,995 | 5/1990 | Lovett et al. | 219/385 |
| 5,190,376 | 3/1993 | Book | 383/4 |
| 5,210,396 | 5/1993 | Sanders | 219/521 |
| 5,408,068 | 4/1995 | Ng | 219/202 |

FOREIGN PATENT DOCUMENTS

| | | | |
|---|---|---|---|
| 2521408 | 2/1983 | France | 219/386 |

*Primary Examiner*—Teresa J. Walberg
*Assistant Examiner*—J. Pelham
*Attorney, Agent, or Firm*—Longacre & White

[57] ABSTRACT

The present disclosure concerns a container for heating textiles. The container is insulated and constructed of flexible materials so as to be collapsible. One or more heating elements inside the container provide heat for warming the textiles.

16 Claims, 2 Drawing Sheets

INSULATED HEATING CONTAINER

This application is a continuation in part of application Ser. No. 29/030,018, filed Sep. 23, 1994, now DES. 365,728.

BACKGROUND OF THE INVENTION a) Field of the Invention

The present invention concerns a container for heating textiles. In particular the present invention concerns a so-called "soft-sided" container including a heating element for warming towels, garments, etc.

b) Description of Related Art

U.S. Pat. No. 2,505,405 (Jarboe) discloses an electrically heated lunch box having separate compartments for warm food, cool food, and a beverage. The Jarboe invention is constructed of rigid, i.e. not collapsible, sides with a hinge connecting the cover to the body of the lunch box. The heating unit 13 of Jarboe is in a separate compartment 11 underneath the warm food compartment.

U.S. Pat. No. 2,577,870 (Aston) discloses an electrically heated lunch kit constructed of "stainless steel or other material suitable for food containing utensils" (column 2, lines 15–17). Further, a hinge (i.e. not a similar type of connection as that between the sides of the lunch kit) connects the top closure part 12 to the box-like container part 11.

U.S. Pat. No. 3,381,115 (Welch) discloses a "molded plastic" (column 1, line 10), electrically heated container "preferably made entirely of synthetic resin in which a heating element is embedded or sealed" (column 1, lines 25–27). The open top tray of Welch does not include collapsible surfaces.

U.S. Pat. No. 3,805,018 (Luong et al.) discloses a portable food storage and warming carrying case. The Luong et al. case uses a heating fluid to transfer heat from heating element 18 to a food container 44 having several compartments 46–52. The Luong et al. "cover 12 and carrier 14 are preferably comprised of an insulative, shock-resistant material, e.g., a thermoplastic" (column 2, lines 6–8).

U.S. Pat. No. 4,537,313 (Workman) discloses a flexible insulated container which is not capable of heating its contents. Instead, the Workman container benignly insulates the contents of the container.

U.S. Pat. No. 4,630,671 (Sherman et al.) discloses a lunch box for keeping its contents cool during hot weather to prevent spoiling of food, and heating its contents if desired. In particular, Sherman et al. disclose a rigid lunch box which includes both a vessel 8 retaining a cooling fluid and a heating element 16.

U.S. Pat. No. 5,190,376 (Book) discloses a collapsible, portable, multiple use insulated bag with a second, attachable, multiple use bag. The primary bag is a cooler and the secondary bag is merely for transporting and storing articles. There is no suggestion of providing a heating element within either bag.

SUMMARY OF THE INVENTION

In many instances it is desirable to have warmed towels (e.g. after bathing) or warmed garments (e.g. when dressing an infant). An objective of the present invention is to provide a flexible, insulated container which includes a heating element for warming textiles such as towels or garments.

DESCRIPTION OF THE PREFERRED EMBODIMENT

Figure 1:
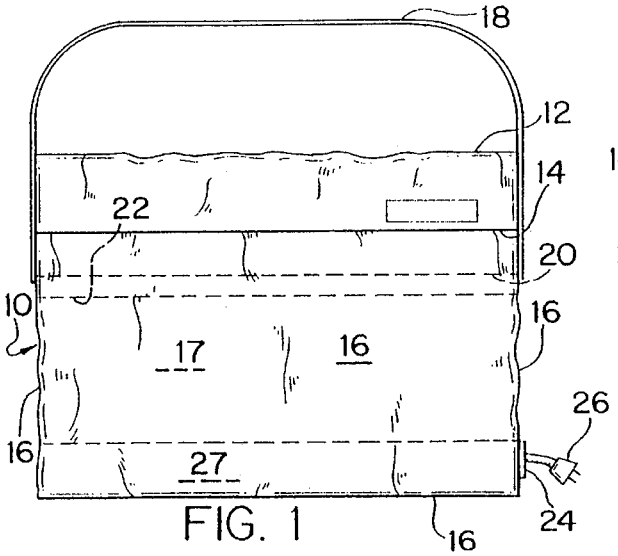
FIG. 1 is a front elevation illustrating the present invention.
Figure 2:
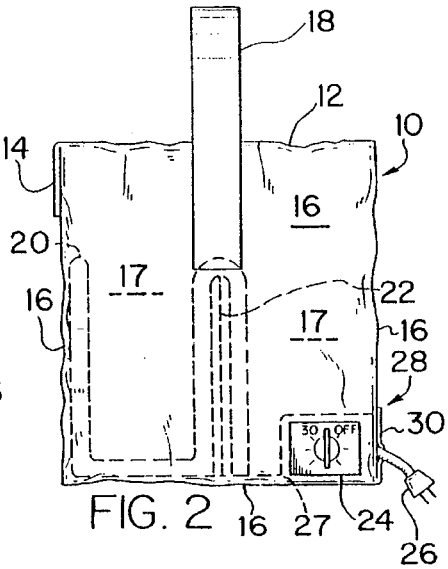
FIG. 2 is a right-side elevation illustrating the present invention shown in FIG. 1.

FIGS. 1 and 2 show the present invention wherein a container 10 includes access to the interior of the container 10 through an aperture in the top of the container 10. A first closure 12 covers the aperture and includes a forward facing flap 14 adapted to secure the first closure 12 to one of a plurality of collapsible surfaces 16. A textile (not shown) is placed within, and removed from, a first enclosure 17 within the interior of the container 10 via the aperture. A handle 18 is provided for ease of carrying the container 10.

At least one heating element 20 is located inside the interior of the container 10 for warming the textile. The heating element 20 is in the form of a flexible sheet covering a majority of at least one surface 16 and/or the first closure 12. In FIGS. 1 and 2, a single heating element 20 is shown covering a majority of both the forward surface 16 and the bottom surface 16.

A partition 22 is shown extending upward from the bottom surface 16 so as to partially divide the interior of the container 10. The heating element 20 in FIG. 1 and 2 is shown extending up one side of the partition 22, over the top of the partition 22, and down the opposite side of the partition 22.

Temperature and/or operating time of the heating element is regulated by a control switch 24 located on the exterior of the container 10. A power cord 26 extends out of the container 10 and provides electrical energy to the heating element 20 via the control switch 24. The power cord 26 is stored within a second enclosure 27 inside the container 10. A second closure 28 includes a rearward facing flap 30 covering the second enclosure 27 and secured to one of the plurality of collapsible surfaces 16.

Figure 3:
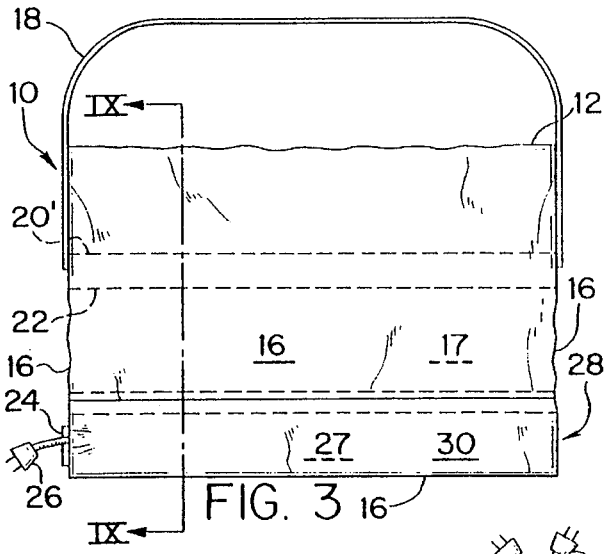
FIG. 3 is a back elevation illustrating a modified version of the present invention.
Figure 4:
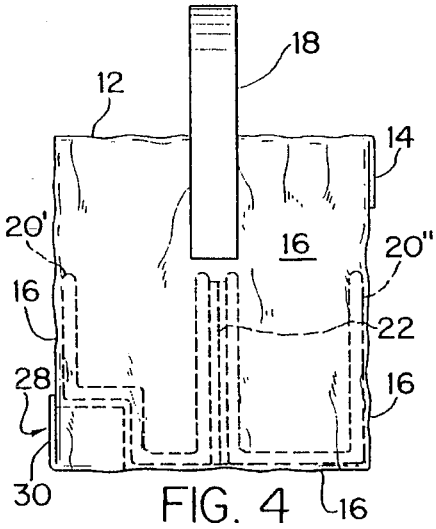
FIG. 4 is a left-side elevation illustrating the modified version of the present invention shown in FIG. 3.
Figure 5:
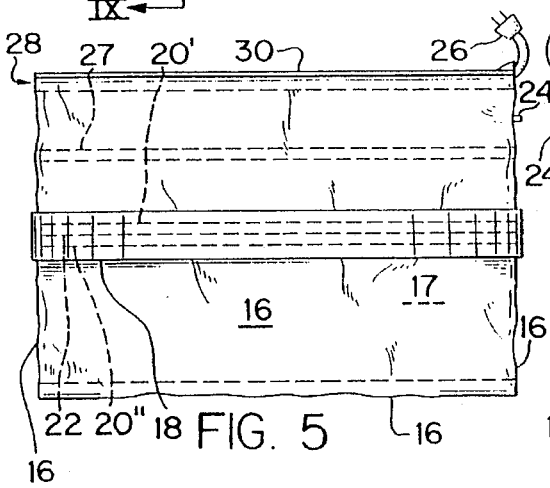
FIG. 5 is a top view illustrating the modified version of the present invention shown in FIG. 3.

FIGS. 3–5 show a modified version of the present invention having two heating elements 20',20" separated by the partition 22. All other elements are similar to those described and indicated with respect to FIGS. 1 and 2. It is also envisioned that the arrangement of the heating elements 20',20" could divide the interior 17 without a separate partition 22 as described above. The control switch 24 may control both heating elements 20',20" or separate controls may be provided for the respective heating elements 20',20".

Figure 6:
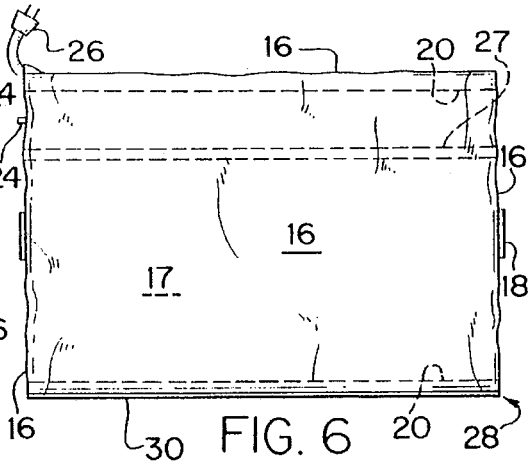
FIG. 6 is a bottom view illustrating an alternate version of the present invention.

FIG. 6 shows an alternate version of the present invention wherein a single heating element 20 covers the bottom of the container 10 and also extends upward over a majority of two opposed surfaces 16 which are adjacent to the bottom of the container 10. In the alternate version illustrated in FIG. 6, no partition is present to divide the interior 17.

Figure 7:
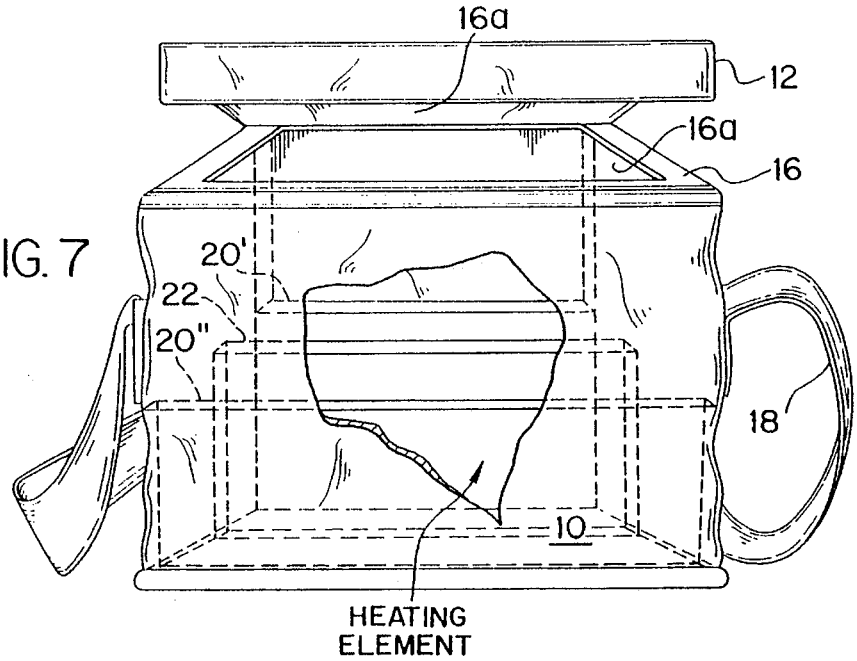
FIG. 7 is a perspective view of the present invention illustrating the interior.
Figure 8A:
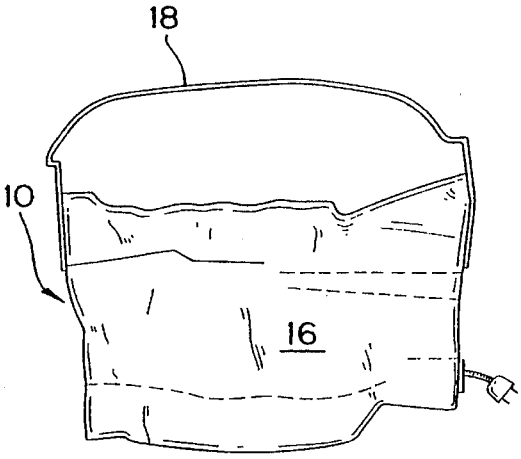
FIGS. 8*a* and 8*b* provide side views illustrating the invention in various collapsed states.
Figure 8B:
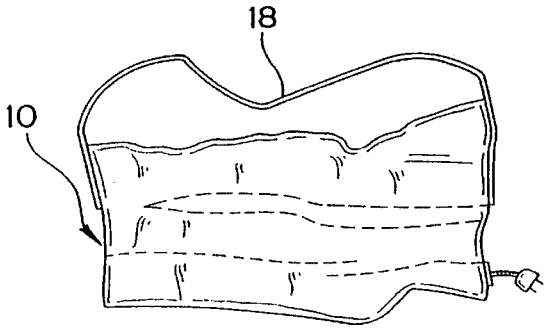
Figure 9:
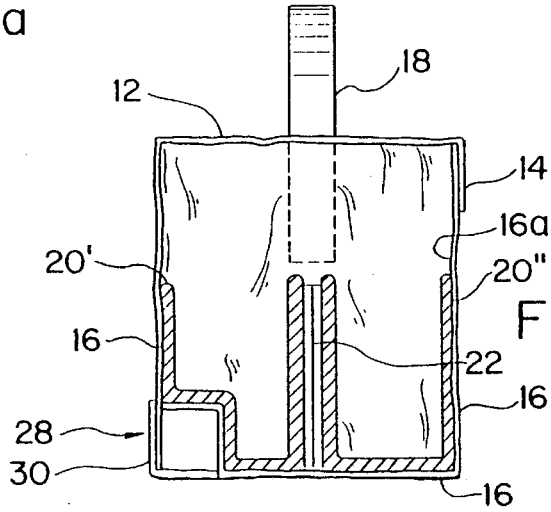
FIG. 9 is a cross sectional view of the container of FIG. 3 shown along section line IX—IX.

In each version of the present invention, it is envisioned that the plurality of collapsible surfaces 16, as well as the first closure 12 could be insulated so as to avoid the transfer of heat from the interior 17 to outside the container 10. FIGS. 7 and 9 illustrate the insulation 16a provided on the collapsible surfaces 16 and the closure 12. FIGS. 8*a* and 8*b* illustrate the container of this invention in various collapsed states.

By virtue of the design of the present invention a large contact surface between the heating element(s) 20,20",20" and a textile provide relatively uniform heat transfer to the textile. Inasmuch as the partition 22 may only partially divide the interior 17, the textile may be folded over the partition to further enhance heat transfer.

Manufacture of the container 10 is preferably accomplished with flexible sheet goods such as fabric or plastics such that connections between the surfaces 16, as well as the connection between the first and second closures 12,28, may be similarly effected by sewing or thermoelectric welding, respectively.

What is claimed is:

1. A container for heating textiles, said container comprising:

a first enclosure including first access means for ingress and egress of the textiles to and from an interior of said first enclosure, said first access means including a first closure covering an aperture into said interior, said first enclosure further including a plurality of collapsible surfaces surrounding said aperture and defining said interior, said collapsible surfaces having an inside face facing said interior, and an exterior face opposite to said interior face;

at least one heating element inside said interior, said heating element being in the form of a separate flexible sheet overlying at least a portion of a first inside face of a first collapsible surface, and continuously extending from said first inside face along a substantially perpendicular second inside face of a second collapsible surface; and control means for regulating said at least one heating element, said control means is mounted on an exterior of the container.

2. The container according to claim 1, further comprising:

first connection means for attaching said plurality of collapsible surfaces to one another; and, second connection means for attaching said first closure to one of said plurality of collapsible surfaces;

wherein said first and second connection means are similar.

3. The container according to claim 1, wherein said at least one heating element extends over a majority of at least two of said plurality of collapsible surfaces.

4. The container according to claim 1, wherein said at least one heating element extends over a majority of said first closure and at least one of said plurality of collapsible surfaces.

5. The container according to claim 1, wherein said at least one heating element extends over one of said plurality of collapsible surfaces opposite said aperture, said at least one heating element further extends over two of said plurality of collapsible surfaces adjacent said aperture and opposite one another.

6. The container according to claim 1, further comprising:

partition means for at least partially dividing said interior into a plurality of volumes.

7. The container according to claim 1, further comprising:

partition means for at least partially dividing said interior into a plurality of volumes, said at least one heating element surrounds said partition means, and said partition means is parallel to said two of said plurality of collapsible surfaces opposite one another.

8. The container according to claim 7, wherein said at least one heating element includes said partition means.

9. The container according to claim 8, wherein said at least one heating means further includes a plurality of spaced apart parallel walls, at least one of said parallel walls is said partition.

10. The container according to claim 1, further comprising:

a second enclosure including second access means for ingress and egress of an electrical power cord for said at least one heating element, said second access means including a second closure for said second enclosure;

wherein said first enclosure is separate and distinct from said second enclosure.

11. The container according to claim 1, further comprising:

insulation substantially surrounding said interior, said plurality of collapsible surfaces and said first closure including said insulation.

12. The container according to claim 1, wherein said separate flexible sheet covers a majority of said first and second faces.

13. The container according to claim 1, wherein said separate flexible sheet further extends along a third collapsible surface which is disposed in parallel relation to said first collapsible surface.

14. A container for heating textiles, said container comprising:

a first enclosure including first access means for ingress and egress of the textiles to and from an interior of said first enclosure, said first access means including a first closure covering an aperture into said interior, said first enclosure further including a plurality of collapsible surfaces surrounding said aperture and defining said interior, each of said collapsible surfaces having an outside surface, an inside surface, and an insulation material provided therebetween;

at least one heating element inside said interior, said heating element being in the form of a separate flexible sheet overlying a portion of at least one said inside surface so as to be retained within said interior, said separate flexible sheet overlapping a portion of said inside surface to define a stepped interior region where said flexible sheet terminates along said at least one inside surface; and control means for regulating said at least one heating element, said control means is mounted on an exterior of the container.

15. The container according to claim 14, wherein said separate flexible sheet continuously extends from a first collapsible surface along a substantially perpendicular second collapsible surface.

16. The container according to claim 15, wherein said separate flexible sheet further continuously extends along a third collapsible surface which is disposed in parallel relation to said first collapsible surface.

* * * * *